United States Patent [19]

Torres et al.

[11] Patent Number: 4,899,400

[45] Date of Patent: Feb. 13, 1990

[54] RAIN-COLLECTION PAD

[75] Inventors: Guillermo M. Torres, Newport Beach; Michael W. Bowler, Laguna Hills; Robert A. Otto, Pasadena, all of Calif.

[73] Assignee: Serrot Corporation, Huntington Beach, Calif.

[21] Appl. No.: 106,061

[22] Filed: Oct. 7, 1987

[51] Int. Cl.[4] ..... B65D 88/34

[52] U.S. Cl. ..... 4/487; 220/216

[58] Field of Search ..... 4/487, 498, 499; 220/219, 216, 218, 227, 226, 493, 488, 496

[56] References Cited

U.S. PATENT DOCUMENTS

| | | | |
|---|---|---|---|
| Re. 18,381 | 3/1932 | Bohnhardt | 220/218 |
| Re. 30,146 | 11/1979 | Dial et al. | 220/219 |
| 1,742,120 | 12/1929 | Afonin | 220/218 |
| 1,902,108 | 3/1933 | Twogood | 220/219 |
| 2,867,347 | 1/1959 | Champagnat | 220/216 |
| 3,029,971 | 4/1962 | Reynolds | 220/218 |
| 3,313,443 | 4/1967 | Dial et al. | 220/219 |
| 3,592,009 | 7/1971 | Alkmaar et al. | 220/219 |
| 3,667,641 | 6/1972 | Dial | 220/219 |
| 3,892,332 | 7/1975 | Iwagami et al. | 220/219 |
| 3,980,199 | 9/1976 | Kays | 220/227 |
| 3,991,900 | 11/1976 | Burke et al. | 220/219 |
| 4,139,117 | 2/1979 | Dial | 220/218 |
| 4,202,460 | 5/1980 | Imbeault | 220/218 |
| 4,213,280 | 7/1980 | Sandborn | 220/218 |
| 4,446,983 | 5/1984 | Gerber | 220/219 |

*Primary Examiner*—A. D. Pellinen
*Assistant Examiner*—Morris Ginsburg
*Attorney, Agent, or Firm*—Harness, Dickey & Pierce

[57] ABSTRACT

A rain-collection pad for ponds comprising a pan-shaped pad having a horizontal bottom and four vertical, contiguous side walls, said pad being adapted to float on the exposed surface of a pond and having a stiffening means attached to at least one wall.

44 Claims, 4 Drawing Sheets

RAIN-COLLECTION PAD

FIELD OF THE INVENTION

The present invention relates to a floating rain-collection pad for outdoor ponds and exposed storage tanks to prevent dilution and/or contamination of the impounded or stored liquid by rain water.

SUMMARY OF THE INVENTION

The present invention is directed to a rain-collection pad adapted to float on a pond or exposed (open-top) storage tank containing aqueous or organic fluids, suspensions, or mixtures thereof, and which is capable of entrapping rain water to prevent dilution of the contents of the pond or exposed storage tank.

The rain-collection pad comprises a pan-shaped pad having a horizontal bottom member and four contiguous, vertical side walls to form an open-top container for holding water. The pad is adapted to float on the exposed surface of a pond containing water, aqueous solutions, organic fluids, suspensions, colloidal solutions, colloidal suspensions, and mixtures thereof. At least one side wall of the pad has means attached to stiffen the side walls. The stiffening means are connected to the pad with attachment means for detachably attaching the stiffening means to the side walls. Preferably, at least two side walls of a rain-collection pad have stiffening means attached thereto, and preferably at least two opposing side walls of a pad have stiffening means. In the preferred embodiment of the present invention, all side walls of the pad have stiffening means.

The stiffening means are preferably longitudinal, block-shaped elements having a rectangular or square cross-section. The stiffening means can be blocks of styrofoam, foam polyethylene, or other foamed polymeric material such as urethane foam. The stiffening means can also be of low-density wood such as balsam wood; hollow, water-tight tanks; or hollow, formed elements having rectangular or square cross-sections. The stiffening means can be made from two channel members placed in an overlapping position with the channel member side walls extending towards each other in an overlapping position so that the resulting exterior wall of the resulting structure is composed of the back side and one side wall of one channel member and the back side and one side wall of the other channel member.

The stiffening means are preferably secured within the rain-collection pad with one side of the stiffening means adjacent the interior side of one side wall of the pad and the bottom side of the stiffening means adjacent the inside surface of the bottom member of the pad. Alternatively, the stiffening means can be attached to the exterior of the rain-collection pad with one wall of the stiffening means adjacent an exterior wall of the pad.

The stiffening means can be attached to the pads by conventional means. Preferably, the stiffening means are secured to the interior of the pad by straps. The straps are attached at one end to the top edge of one side wall, extend from the top edge of the side wall across the top of the stiffening means toward the opposite side wall, extend around the edge of the stiffening means, down the side of the stiffening means opposite the side wall, and are attached to the bottom member of the pad. Preferably, sufficient clearance is allowed between the strap and the stiffening means to permit the stiffening means to be slid out from the straps when disassembly of the pad is necessary, or to slide the stiffening means into the straps during assembly of the pad.

To cover a pond, a plurality of pads are fastened together to cover substantially all of the exposed surface of the pond or exposed storage tank. For ease of manufacture, the pads are normally made to a standard width, but can be manufactured to various lengths. This permits a multi-pad, continuous cover to be constructed from a plurality of rain-collection pads fastened in a side-by-side arrangement. Normally, the pads are arranged in rows and columns to form a continuous cover. Adjacent pads are detachably fastened together, employing a U-shaped channel having a backing element with two approximately-perpendicular, downwardly-extending side walls. The side walls of the U-shaped channel normally extend the same distance as the side walls of the pads so that the side walls fully cover the side walls of the pads and/or the stiffening means. It is particularly important, when the stiffening means are made of materials sensitive to the elements, including the sun and its ultraviolet radiation, to have the U-shaped channel cover the exposed surfaces of the stiffening members. If two adjoining side walls having no stiffening means are to be joined, there is provided a channel element having a very narrow throat with a backing member and two downwardly extending skirts adapted to receive the juxtaposed side walls of adjoining pads. For added security, the upper portion of the side wall and the channel can be bored to receive a locking pin to secure together the channel member and the two adjoining side walls.

When the adjoining pads have longitudinal block elements as stiffening means, the fastening means can comprise a U-shaped channel element having a wide throat with a backing member and two downwardly-extending skirts. The channel element is adapted to engage the sides of the stiffening means opposite the side walls of the pad. When the side walls of two adjoining pads are separated by a longitudinal, block-type stiffening means, the pads can be fastened together with a channel element having a moderate-width throat formed by a backing member with downwardly-extending skirts adapted to engage the interior walls of the side walls of the pad.

The rain-collection system preferably includes a means for securing the position of the multi-pad, continuous cover in the pond. The securing means can be one, or more, cable(s) extending across the pond, with the ends of the cable attached to pier means. Preferably, each cable is positioned parallel to, and extending along, a row or column of pads, with at least one pad attached to the cable by attachment means.

In a preferred embodiment of the invention, at least one cable extends across the multi-pad, continuous cover in an X direction, and at least one other cable extends across the multi-pad, continuous cover in a Y direction. The cables are secured to the cover by running the cables underneath at least one fastening means channel element between the interior surface of the channel element and the top surface of the stiffening means. To prevent abrasion of the backing member and/or stiffening means by the cable, the cable can be sheathed in a tubular sleeve. In a preferred embodiment of the present invention, each pad of the multi-pad, continuous cover is accessible by, or can be serviced from, either side of the pond or on one, or more, walkway(s). Each walkway is preferably built up from a narrow, pan-shaped pad having a horizontal bottom element with vertically-extending side walls. The walkway pad is filled with the block-type stiffening means to form a rigid and solid float. The walkway float is positioned between two rows or columns of pads and connected to the pads by a U-shaped channel element having a wide throat with a backing member and two downwardly-extending skirts. The downwardly-extending skirts are adapted to receive and engage the interior walls of the pads adjoining the walkway float. If the adjoining pads have stiffening means, the U-shaped channel member is adapted to extend over the stiffening means and engage the side walls thereof. The backing member of the U-shaped channel element, which rests primarily on the block-type stiffening means in the float pad, and the two enjoining pads form a relatively firm and wide walkway surface, giving access to the continuous cover for maintenance, repairs, inspection, and the like. Following a rainstorm, the pads will frequently have to be pumped out, and access to the pads is required.

DETAILED DESCRIPTION OF THE INVENTION

Figure 1:
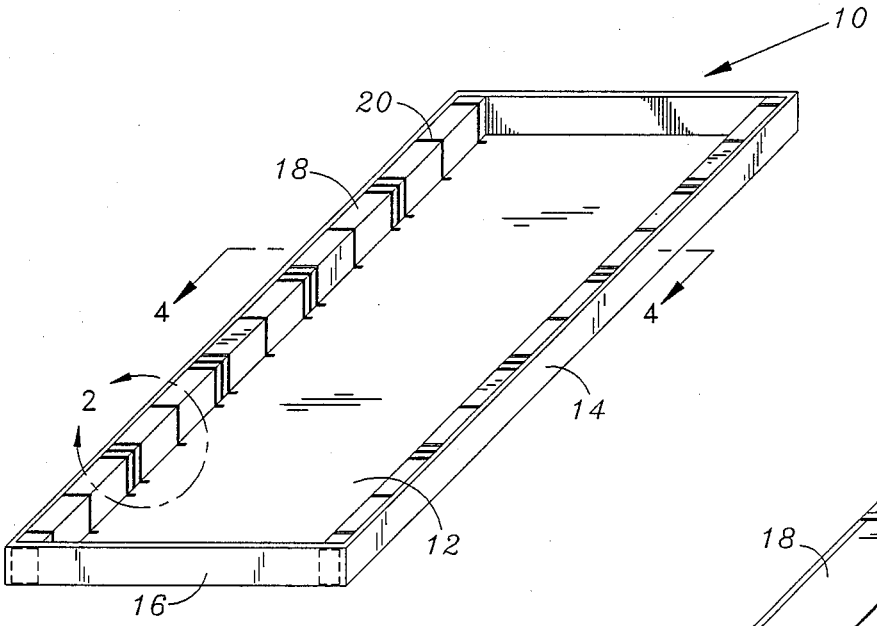
FIG. 1 a perspective view of a rain-collection pad of the present invention having stiffener blocks on two sides.

Referring to FIG. 1, a rain-collection pad 10 is shown having a horizontal flat bottom 12 with contiguous, upwardly-extending, vertical longitudinal walls 14 and contiguous upwardly-extending, vertical end walls 16. The pad is open-topped, and the joints and seams between the bottom and the walls are sealed to form an open-topped water-tight container. Within the pad, extending along interior sides of the longitudinal walls, are positioned a plurality of stiffener blocks 18. Each stiffener block is attached to the pad by three attachment straps 20.

Figure 2:
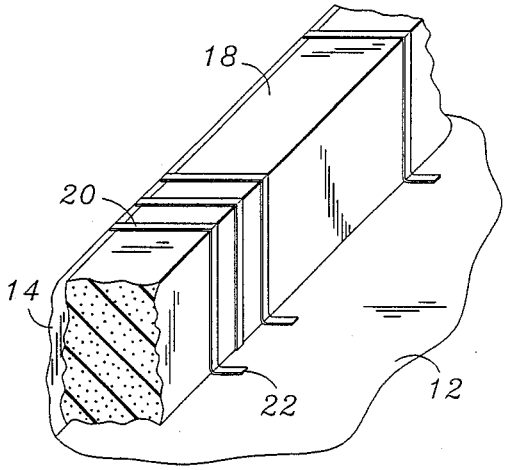
FIG. 2 is an enlarged perspective view of the stiffener blocks taken along line 2 of FIG. 1.
Figure 4:
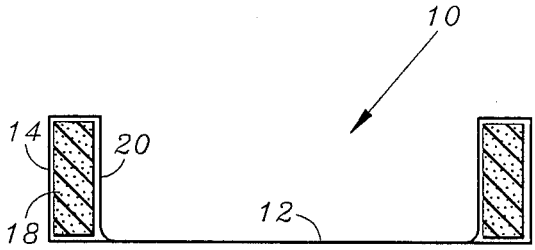
FIG. 4 is a cross-section of the rain-collection pad of FIG. 1 take along line 4—4.

Referring to FIG. 2, the attachment straps are secured to the top of the longitudinal walls, extend across the top of the stiffener blocks and down the inner wall of the blocks (i.e., the surface opposite the other side wall of the pad) to the flat bottom, wherein the strap end 22 is attached. The pad is illustrated having stiffener blocks along the two opposing longitudinal walls of the pad (FIGS. 1 and 4). However, the pads can be fabricated with stiffener blocks along only one wall, along only two adjoining walls, along three walls, or, preferably, along all four walls. Thus, pad 10 of FIG. 1 would preferably have stiffener blocks also attached along vertical end walls 16.

Figure 6:
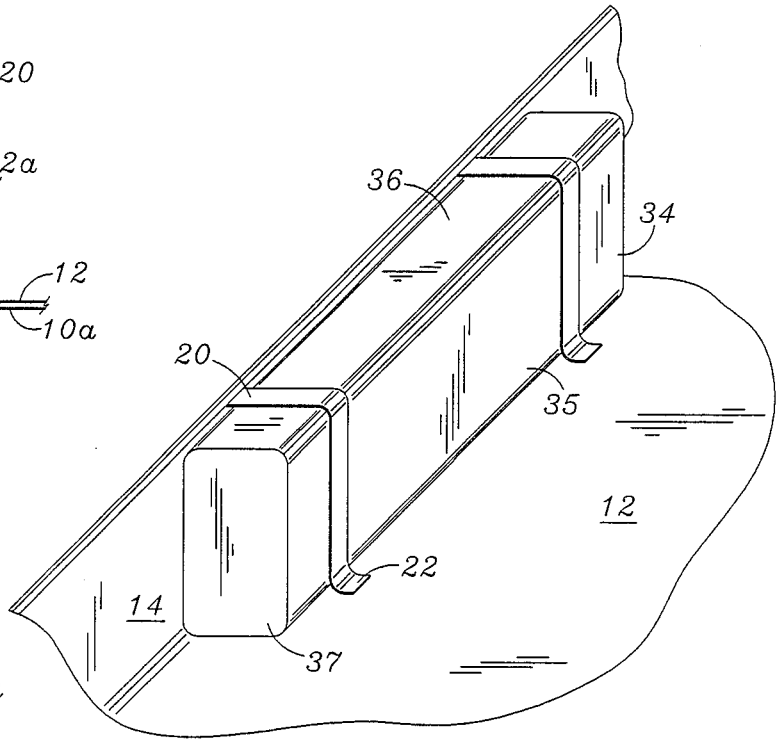
FIG. 6 is a partial perspective view of a rain-collection pad of the present invention having hollow stiffener tanks.

The stiffener blocks can be made from a variety of materials, including foamed polymeric materials, such as styrofoam, foamed urethane, and polyethylene foam. Alternatively, the stiffener blocks can be made from low-density woods, such as balsam wood and the like, or they can be hollow stiffener tanks 34 (FIG. 6) having sides 35, top 36 and an opposing bottom (not shown), and ends 37 forming a sealed, water-type tank. Preferably, the stiffener blocks float in water to increase the buoyancy of the pads when they are flooded. The stiffener tank is attached to the pad by attachment straps 20. The stiffener tanks can be made from a polymeric material, such as polyethylene or polypropylene sheets, fiberglass, rubberized fabric, or metal sheeting, such as galvanized steel, and the like.

Figure 5:
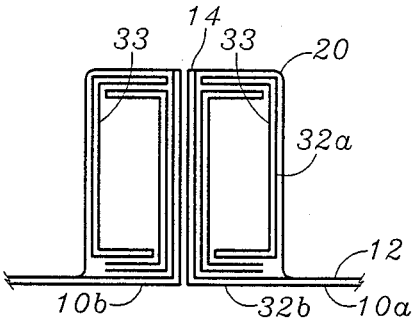
FIG. 5 is a partial cross-sectional view of two rain-collection pads of the present invention having channel-shaped stiffeners in a side-by-side position.

Alternatively, the stiffener blocks 18 can be fabricated from formed or molded elements, such as channel elements **32*a* and 32*b* shown in FIG. 5. The two channel members are placed in an overlapping position with their throats, or open sides, facing each other, to form longitudinal elements 33 having a rectangular cross-section. Thus, one of the side walls and the backing member of one channel element forms two sides of the rectangular element, and the backing member and side wall of the other channel element forms the other two sides of the rectangular element. The channel elements can be welded together, riveted together, bolted together, or secured together by adhesive means. Alternatively, the channel members can be secured to one another by strapping. The finished rectangular element is attached to the pad by attachment straps 20**, as described above.

Figure 7:
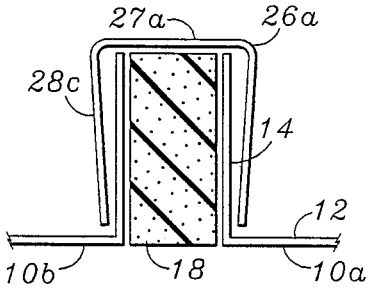
FIG. 7 is a partial cross-sectional view of two rain-collection pads of the present invention having a common stiffener block in a side-by-side position.
Figure 9:
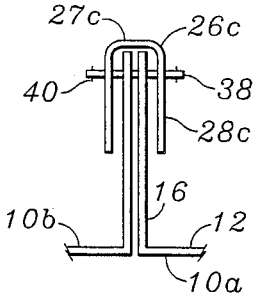
FIG. 9 is a partial cross-sectional view of two rain-collection pads of the present invention having no stiffeners, in a side-by-side position.

In FIG. 7 there is illustrated a stiffening element positioned between two pads. The stiffening element will be maintained in place by the side walls 14 of the pad, the backbone **27*a* of channel-fastening element 26*a*, and the hydrostatic pressure of the fluid in which the pads and stiffener blocks are floating. Alternatively, the stiffener blocks can be adhesively bound to one or both of the side walls of the pads or, alternatively, secured to the side walls by pins, such as shown in FIG. 9**.

Preferably, the pads are fastened together with fastening element **26*a*, which has a backing member 27*a* and downwardly-descending skirts 28*c*, to form an open throat or side adapted to receive and engage the side walls 14 and the top of the stiffener blocks 18**.

Figure 8:
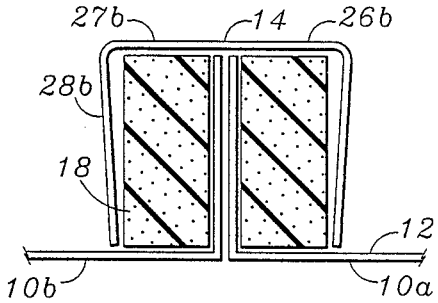
FIG. 8 a partial cross-sectional view of two rain-collection pads of the present invention in a side-by-side position.

Referring to FIG. 8, two pads, similar in construction to the pads shown in FIG. 1, are positioned next to each other in a side-by-side relationship. The two pads are fastened together with channel-fastening element 26*b*, having a backing member 27*b* and descending side skirts 28*b*, which form an open throat adapted to receive and engage the interior sides of stiffener blocks 18. The resulting structure not only fastens adjoining pads to each other, but also serves as a narrow walkway on which operators can walk and from which individual pads can be inspected, repaired, maintained, and pumped out. The walkway is spaced above the floor of the pad, thus giving the operator access to the pad without having the operator walk on the flat bottom of the pad which can be covered with water and the like.

In FIG. 5, two pads 10*a* and 10*b* are shown in a side-by-side position. These two pads can be fastened together with a fastening element 26 (not shown in FIG. 5), similar to the channel-fastening element 26*b* of FIG. 8.

FIG. 9 illustrates a means of joining two rain-collection pads that have no stiffener blocks. The two end walls of pads 10*a* and 10*b* are attached with channel-fastening element 26*c* having a backing member 27*c* and downwardly-descending side skirts 28*c* forming a narrow, open throat, which is adapted to receive and engage the interior side of end wall 16 of each pad. The channel-fastening element can alternatively have descending side skirts that reach down to the inner surface of the flat bottom 12 of the pads. The side skirts and the upper portion of the end walls are coaxially apertured to receive bar 38 having lock pins 40 to lock the channel-fastening element with the end walls. The lock pins can be removed to remove or insert the bar for disassembly or assembly of the pads.

Figure 10:
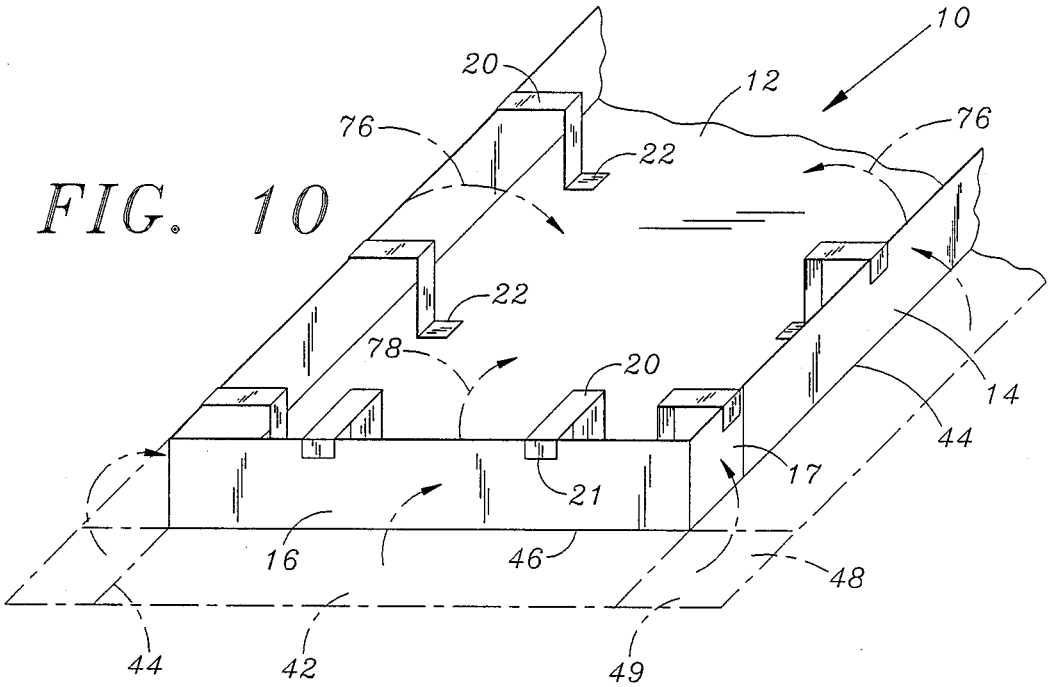
FIG. 10 is a partial perspective view illustrating the fabrication of a rain-collection pad of the present invention.

Referring to FIG. 10, the pads can conveniently be prepared from a single sheet of material, such as metal sheeting, polymeric material sheeting, or rubberized fabric sheeting. Preferably, the pads are prepared from high-density polyethylene of 40 to 100 mil thickness. Preferably, the polyethylene sheeting is compounded with UV absorbers and/or carbon black. The sheeting 42, shown in dotted lines, is scored along longitudinal fold lines 44 and lateral fold lines 46. This sheeting is cut at cut line 48. The portions of the sheet forming vertical, longitudinal walls 14 are rotated upwardly to a vertical position. The portion of the sheeting that will form the vertical end walls 16 is rotated upwardly, and end flaps 49 attached to end walls 16 are folded at a 90° angle against longitudinal walls 14. Depending upon the material of construction, the end flap can be welded, bolted, riveted, or adhesively bound to longitudinal wall 14 to form a contiguous water-tight joint. When the material is high-density polyethylene sheeting, the end flaps 49 can be readily welded to longitudinal wall 14.

After the pad is assembled as described above, the attachment straps 20 are added to the pad by welding one end 21 of each strap to the exterior sides of the walls 14 and 16, and the other end 22 of each strap to the interior side of the flat bottom 12. The attachment straps are attached to the pad, depending upon the material of construction, by conventional means, such as welds, rivets, adhesives, bolts, and the like. When the pad and straps are constructed of high-density-polyethylene material, the straps can be welded to the pad.

Figure 12:
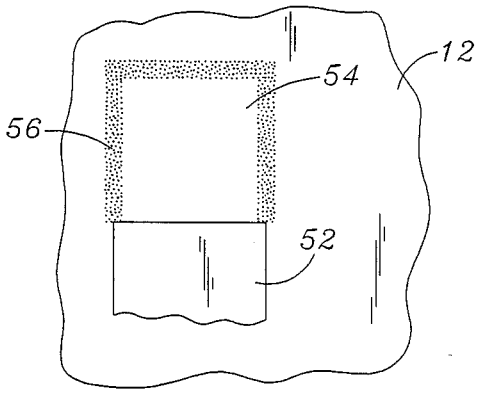
FIG. 12 is a plane view taken along lines 12—12 of FIG. 11.
Figure 11:
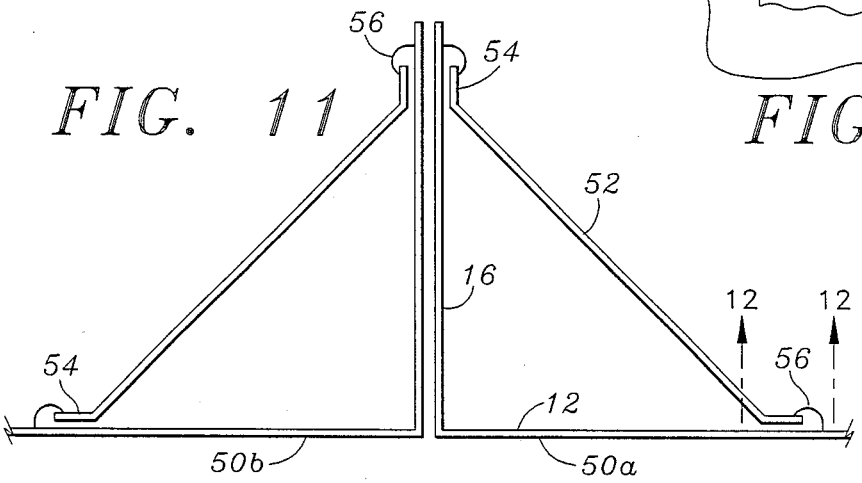
FIG. 11 is a partial cross-sectional view of two rain-collection pads of the present invention having strut stiffeners in a side-by-side position.

FIG. 11 illustrates an alternative embodiment of the present invention wherein the pads are assembled without stiffener blocks 18. The alternative rain-collection pads 50*a* and 50*b* have braces 52 extending from the interior side of flat bottom 12 of each pad, spaced apart from end wall 16 and extending upwardly towards the top of end wall 16. The ends 54 of the brace 52 are secured to the top interior sides of the end wall and to the flat bottom, depending upon the material, with bolts, rivets, welds, or adhesive material. When the pad is constructed of high-density polyethylene sheeting, the braces can be made of stiff high-density polyethylene sheeting (60 to 100 mil) by welding ends 54 to the flat bottom 12 and the top of the end walls 16. The weld seam 56 is shown in FIGS. 11 and 12.

Figure 13:
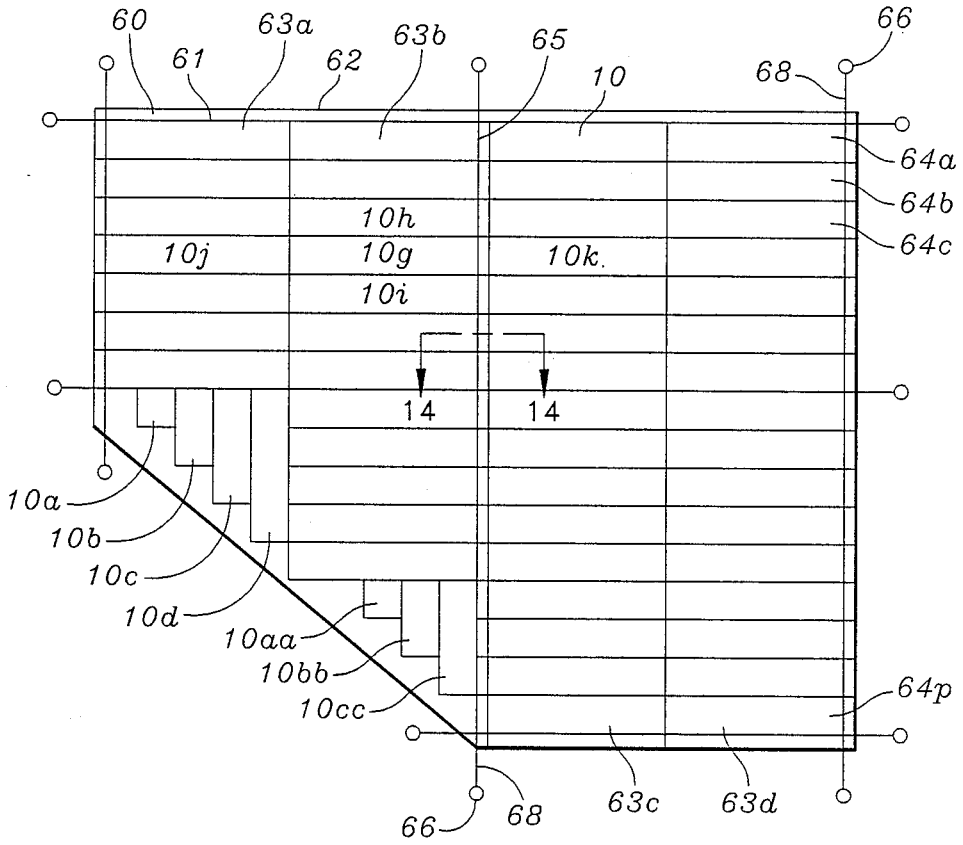
FIG. 13 is a plane view of a multi-pad, continuous cover of the present invention.

Referring to FIG. 13, a pond 60 has a continuous cover made up of a plurality of rain-collection pads 10. The pond is roughly rectangular in shape, with the lower-left corner cut off at an angle. The outer perimeter of the continuous cover 61 parallels the perimeter 62 of the pond. Smaller pads 10*a*, 10*b*, 10*c*, 10*d*, 10*aa* 10*bb*, and 10*cc* arranged in a stepped fashion in FIG. 13, are employed to cover those portions of the perimeter of the pond that are not parallel to the sides of the pads. The pads are arranged in four columns 63*a*, 63*b*, 63*c*, and 63*d*. The columns are aligned so that pads form rows 64*a*, 64*b*, 64*c*, et. seq. A walkway 65 bisects the continuous cover and provides, with the perimeter area of the pond, direct access to each pad. Each pad in the continuous cover is fastened to the adjoining pad on each side, employing the channel-fastening members described above. For example, pad 10*g* is fastened to pad 10*h*, located above it, and to pad 10*i*, located below it, and to pad 10*j*, located to its left, and to pad 10*k*, located to its right.

Cable piers 66 are located around the perimeter of the pond, outside the pond, for attaching cables 68 which extend across the pond. Preferably, at least one cable extends across the pond and is slideably attached to the continuous cover, to maintain the position of the cover. Most preferably, at least two cables—one in the X direction and one in the Y direction—are extended across the pond and slideably attached to the cover to prevent the cover from being moved from side to side on the pond. In a most preferred embodiment, cables are also extended along the periphery of the cover to further stabilize the position of the cover in the pond and to prevent wind from lifting the cover off the surface of the pond.

Figure 3:
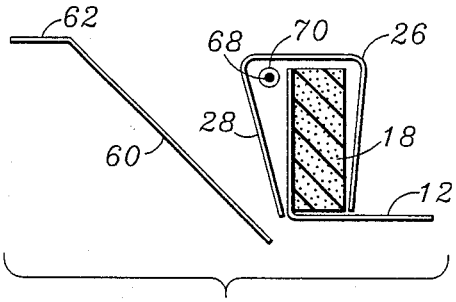
FIG. 3 is a partial cross-section of a side of a rain-collection pad having a cable for positioning and a cable-securing means.

The longitudinal walls and end walls of the pads on the exterior perimeter of the continuous cover are exposed to the edge of the pond, which can be of concrete, asphalt, gravel, sand, earth construction, or the like. To prevent abrasion to the end walls and side walls, and to slideably secure the cables to the outer periphery of the continuous cover, a channel-fastening element 26 (FIG. 3) is placed over the stiffener block 18 and the wall of the pad as shown. The exterior downwardly-extending skirt 28 of the channel-fastening element shields the pad walls, the bottom, and the adjoining corner from abrading on the perimeter or side wall 62 of the pond 60. To prevent the cable from abrading the channel-fastening element, the side wall, and/or the stiffener element, the cable is sheathed with a tubular sleeve 70.

Figure 14:
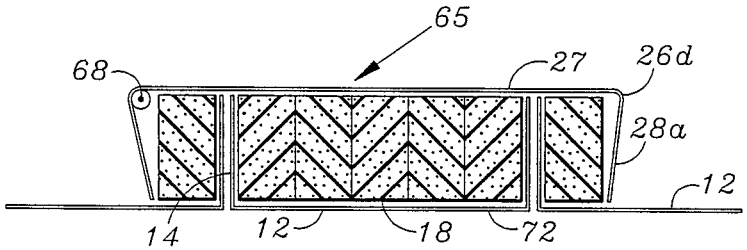
FIG. 14 a partial cross-sectional view of a walkway of the multi-pad, continuous cover taken along lines 14—14 of FIG. 13.

The construction of the walkway 65 is shown in FIG. 14. The walkway comprises a channel-fastening member 26*d*, stiffener blocks 18, and a walkway pad 72. The walkway pad 72 is interdisposed between adjacent rain-collection pads. The walkway pad 72 has the same height as the rain-collection pads but is narrower, and is filled with a plurality of the stiffening blocks 18. The walkway pad is constructed so that its entire interior is filled with stiffening blocks. Rain-collection pads are positioned along the longitudinal sides of the walkway pads and are secured thereto by the channel-fastening elements **26*d* having a broad backing member bone 27 and downwardly-descending side skirts 28*a*, to create a wide open throat which is adapted to receive and engage the walkway pad and the walls and stiffener blocks of the adjacent rain-collection pads. Conveniently, the cable 68 can be located within the channel-fastening element 26*d*** to slideably connect the cable to the continuous cover. The height of the stiffening elements in the walkway pad and on the adjoining rain-collection pads are, when mounted in the pads, the same height as the top of the pad walls. Thus, the top surface of the channel-fastening member is fully supported along its entire width and length so that an operator can use the top surface of the backing member of the walkway as a support surface, to have access to all the pads attached thereto.

The channel-fastening elements 26 also serves to protect the stiffening blocks from the environment. This can be particularly important when the stiffening blocks are made from materials sensitive to sunlight, such as styrofoam. When the stiffening block is made from styrofoam, the downwardly-descending side skirts of the channel-fastening element is preferably of sufficient length as to extend almost to the inner surface of the flat bottom of the pad, to completely cover the block. The channel-fastening element can be made from any stiff but resilient material, such as metal or a hard polymer. We have found that the channel-fastening element can be advantageously made from an extruded copolymer of polyvinyl chloride and high-density polyethylene. Preferably, the copolymer is formulated with an ultraviolet absorber and/or carbon black.

Pads measuring 10 feet in width, one foot in height, and 100 feet in length are being manufactured and sold as a standard pad for the multi-pad, continuous cover. Custom pads less than 100 feet in length are fabricated to fill in those areas of the continuous cover where the periphery of the ponds or exposed storage tanks do not permit the use of a standard pad such as pads **10*a* et. seq. shown in FIG. 13. The standard walkway pads measure five feet in width, one foot in height, and 100** feet in length. Custom pads shorter than 100 feet are manufactured so that the walkway has the same length or width as the multi-pad, continuous cover. These pads are stiffened with block, styrofoam stiffening elements that are four inches wide, one foot high, and eight feet long. Twelve stiffening elements are placed on the interior side of each longitudinal wall of each standard pad. A short, four-foot-long stiffening element is also placed on each longitudinal wall so that stiffening elements extend the full 100-foot length of the pad. One stiffening element is placed at each of the end walls. The stiffening elements are maintained in position by the attachment straps, using three attachment straps for each stiffening element. It has been found satisfactory to have an attachment strap positioned one foot from the end of each stiffening element and one strap in the middle of each stiffening element.

The standard pads are prepared from 60-mil, high-density, polyethylene sheeting having a carbon black filler. The sheeting measures 12 feet in width, and comes in rolls of several hundred feet. Referring to FIG. 10, the sheet is cut to 102 feet in length and is laid out flat. Longitudinal-score fold lines 44, made by a hot iron, are run the length of the sheet, one foot from each edge. Lateral-score fold lines 46, made by a hot iron, are run across each end, one foot from the end of the sheeting. One-foot cuts along cut line 48 are made at each corner. The longitudinal side walls and the end walls are folded up at 90°, and the end flaps 49 are folded 90° to overlap the ends of longitudinal side walls 14. The end flaps are welded to the longitudinal side walls to form a tight, leak-proof joint. A series of attachment straps 20, made from a 60-mil, high-density, polyethylene sheeting, are then welded to the walls and the interior surface of the flat bottom of the pads. The straps can be of any width, and one-inch- to two-inch-wide straps have been used. The straps are of sufficient size to permit stiffener blocks 18 to be slid in and out from underneath the strap. One end 21 of the strap is welded to the top of the exterior side of the walls, and the other end 22 of the strap is welded to the interior surface of the flat bottom. Straps are placed on the longitudinal walls as well as the end walls.

After fabrication of the pad, including the attachment straps but before the installation of the stiffening elements, the side walls are folded over to lay on top of the interior surface of the flat bottom, as shown by arrow 76 in FIG. 10. The end walls 16 are then folded over to lay on top of the flat bottom 12, as shown by arrow 78 in FIG. 10. The attachment straps fold along their crease lines and fold flat along with the longitudinal side walls and the end walls. The folded pad can then be rolled, commencing at one end, lengthwise into a large roll for ease of transportation. Each standard pad rolls into a roll three to four feet in diameter and ten feet in length. The rolled pad is tied or strapped to maintain its shape for transportation and storage. Thus, the pads, the stiffening elements, and the channel-fastening elements are shipped as separate elements to the location of the pond. At the pond, the rolled pad is unrolled, which it will do on its own, with the longitudinal side walls and end walls rebounding into an upright position. The stiffening blocks can then be inserted into position by sliding them underneath the attachment straps, and the completed pad can be slid onto the surface of the pond. (A completed standard pad weighs about 600 pounds.) After a second pad has been fabricated with stiffeners and slid onto the pond, the two pads are positioned in a side-by-side relationship and fastened together with channel-fastening elements. For channel-fastening elements constructed of polyvinyl chloride acrylamide and formulated with carbon black and having one-foot side skirts, four-foot lengths have been found to be convenient to use.

The resulting pads are quite stable and can support a number of operators walking along the flat bottom without tipping or sinking the pad. Each standard pad can easily trap up to nine inches of rain water without captured rain water overflowing into the covered pond. The pads can easily be pumped out using a hose connected to a pump during or following a rain storm. It is not necessary for an operator to actually enter a pad in order to pump it out, although the operator can enter the pad to form the lowest spot on the flat floor, which will assure that the water concentrates at the lowest spot during the pumping operation. Black pads absorb a considerable amount of heat energy from the sun, which is transferred to any water in the pad. This heat capture enhances the ability of the pads to evaporate any water contained therein. Since the pads, when fastened together, form a relatively continuous cover over a pond, they minimize evaporation from the pond, even though the pond is warmed by the heat-collection properties of the continuous cover.

When the continuous cover is to be secured by a cable system, such as the system in FIG. 13, the cables are preferably extended across the pond before assembly of the cover. The pads are aligned along the cable so that, upon assembly with the channel-fastening member, the cable can be incorporated into the assembled cover right from the start, to insure proper alignment of the pads.

The walkway pads are fabricated and assembled in substantially the same manner as the rain-collection pads. The walkway pads are one foot high, five feet wide, and 100 feet long. For transportation and storage, they are folded and rolled in the same manner as the rain-collection pads. At the pond location, the transported, rolled walkway pad is permitted to unroll. The walkway pad is filled with stiffening elements from side to side and from end to end. The standard stiffening element employed in the present invention has been styrofoam blocks that are four inches wide, one foot high, and eight feet long. These styrofoam blocks can be added to the pad before it is slid onto the pond surface or after it is on the surface. Frequently, the continuous pad is built out from the walkway pad, permitting the continuous cover to be assembled and installed in two directions at once. Preferably, during the installation and assembly of the walkway pads, the securing cable is incorporated into the assembly as described above with respect to FIG. 14.

Conventional pond covers are unitary structures that constitute a single catch basin. The rain water captured by such covers, as long as the water is not contaminated, can be discharged without treatment. If the cover is punctured, the captured rain water will be contaminated by the pond water. If the pond contains waste materials, toxic materials, or the like, the captured rain water will be contaminated with such materials via the puncture, rip, or tear in the cover and must be treated as waste material, toxic material, or the like before discharge.

One of the many advantages of the present continuous pond cover arises from its modular construction. If a pad of the present invention is punctured, only the rain water entrapped in that pad will be contaminated by the pond material. The contents of the punctured pad are segregated from the contents of the remaining "sound" pads. Thus, the entrapped rain water of the "sound" pads can be discharged without treatment, and only the entrapped rain water of the punctured pond has to be treated before discharge.

What is claimed is:

1. A rain-collection pad for exposed surfaces of liquids or suspensions comprising a pad having a horizontal bottom wall, four vertically extending contiguous side walls, an open top, stiffening means attached to at least one of the side walls to stiffen at least one of the side walls, attachment means connected to the pad for detachably attaching stiffening means to at least one of the side walls, said pad being adapted to capture rain water and to float on the exposed surfaces liquids or suspensions.

2. The rain-collection pad according to claim 1 wherein said pad has stiffening means detachably attached to at least two opposing side walls.

3. The rain-collection pad according to claim 1 wherein said pad is a rectangular-shaped structure having two opposing longitudinal side walls and two opposing end side walls.

4. The rain-collection pad according to claim 3 wherein said stiffening means are detachably attached to the two opposing longitudinal walls of said pad.

5. The rain-collection pad according to claim 1 wherein said pad has stiffening means detachably attached to each of its side walls.

6. The rain-collection pad according to claim 1 wherein the stiffening means comprises a longitudinal, block-shaped element having a rectangular cross-section adapted to fit against the full height of the side wall.

7. The rain-collection pad according to claim 6 wherein the stiffening means for each side wall comprises a plurality of longitudinal, block-shaped elements having a rectangular cross-section which extend along the entire length of each side wall and extend to the height of each side wall.

8. A rain-collection pad according to claim 6 wherein the longitudinal, blocked-shaped element having a rectangular cross-section is made from a foamed polymeric material.

9. A rain-collection pad according to claim 8 wherein the foamed polymeric material is styrofoam.

10. A rain-collection pad according to claim 8 wherein the foamed polymeric material is foamed urethane.

11. A rain-collection pad according to claim 8 wherein the foamed polymeric material is polyethylene foam.

12. The rain-collection pad according to claim 1 wherein the stiffening means is adapted to fit within said pad adjacent said side wall and said horizontal bottom.

13. The rain-collection pad according to claim 1 wherein the stiffening means is adapted to fit outside the pad adjacent said side wall.

14. A rain-collection pad according to claim 1 wherein the horizontal bottom wall, and four vertically extending contiguous side walls are prepared from a single sheet of high density polyethylene.

15. A rain-collection pad according to claim 14 wherein high density polyethylene sheet is from about 40 to about 100 mil in thickness.

16. A rain-collection system for exposed surfaces of liquids or suspensions comprising fastening means, a plurality of quadrilateral rain-collection pads detachably secured with said fastening means in a side-by-side arrangement to form a multi-pad continuous cover extending in the X-Y directions on the exposed surfaces of the liquids or suspensions, each pad having a horizontal bottom wall, four contiguous side walls, and an open top; stiffening means attached to at least one of the side walls to stiffen at least one of the side walls; and attachment means connected to the pad for detachably attaching stiffening means to at least one of the side walls, each pad being adapted to capture rain water and to float in the liquids or suspensions with the outer surface of the horizontal bottom of each pad in contact with the liquids or suspensions.

17. The system according to claim 16 wherein each pad has stiffening means detachably affixed with attachment means to at least two side walls of each pad.

18. The system according to claim 16 wherein each pad has stiffening means detachably affixed with attachment means to at least two opposing side walls.

19. The system according to claim 16 wherein the pads are rectangular-shaped structures having two opposing longitudinal walls and two opposing end walls.

20. The system according to claim 19 wherein said two opposing longitudinal walls are the long walls of each pad.

21. The system according to claim 16 wherein each pad has stiffening means detachably attached to all of its side walls.

22. The system according to claim 16 wherein the stiffening means comprises a longitudinal block-shaped element adapted to fit against at least one side wall of pad.

23. The system according to claim 22 wherein the stiffening means is adapted to fit within a pad adjacent said side wall.

24. The system according to claim 22 wherein the stiffening means is adapted to fit outside a pad adjacent said side wall.

25. The system according to claim 23 wherein the fastening means comprises at least one channel element having a backing member with downwardly-extending skirts adapted to engage an interior side of the stiffening means on adjoining pads to detachably secure the adjoining pads.

26. The system according to claim 24 wherein the stiffening means is positioned between and exterior to the side walls of adjacent pads.

27. The system according to claim 26 wherein the fastening means comprises at least one channel member having a back element with two downwardly-extending skirts, the inner sides of which are adapted to receive and engage the inner sides of the side walls of adjacent pads.

28. The system according to claim 22 wherein the longitudinal block-shaped element is made from a foamed polymeric material.

29. The system according to claim 28 wherein the foamed polymeric material is styrofoam.

30. The system according to claim 28 wherein the foamed polymeric material is foamed urethane.

31. The system according to claim 28 wherein the foamed polymeric material is polyethylene.

32. The system according to claim 16 wherein the fastening means comprises at least one channel element having a backing member with downwardly-extending skirts adapted to engage the inner sides of the side walls of adjacent pads.

33. The system according to claim 16 wherein said stiffening means comprising a pair of channel elements, each channel element having a back section and two perpendicularly-extending parallel side sections, the two channel elements being fitted together with the side sections in an overlapping relationship to form a four-walled element having a quadrilateral cross-section.

34. The system according to claim 33 wherein the two channel elements are held together by attachment means.

35. The system according to claim 16 including a means for securing the position of the multi-pad continuous cover on the exposed surfaces of the liquids or suspensions.

36. The system according to claim 35 wherein the securing means comprises at least one cable extending across the liquids or suspensions and slideably attached to the multi-pad continuous cover, the ends of the cable being secured on opposite sides of the of the liquids or suspensions to pier means, said cable being positioned parallel to and extending along the juncture of adjoining rows or columns of pads.

37. The system according to claim 35 wherein the securing means comprises at least one cable extending across the the liquids or suspensions in an X-direction and at least one other cable extending across the liquids or suspensions in a Y-direction.

38. The system according to claim 16 wherein the position of the multi-pad continuous cover on the exposed surfaces of the liquids or suspensions is slideably secured with at least one cable extending across the liquids or suspensions and secured on opposite sides of the liquids or suspensions, the cable being secured to the multi-pad continuous cover by the fastening means.

39. The system according to claim 38 wherein the cable is run underneath at least one channel element between the backing member and stiffening means.

40. The system according to claim 39 wherein the cable has a tubular sleeve on the exterior thereof.

41. The system according to claim 16 wherein the bottom wall and four contiguous side walls of each pad is made from a single sheet of high density polyethylene.

42. The system according to claim 41 wherein the high density polyethylene sheeting has a thickness of about 40 to about 100 mil.

43. A rain-collection system for exposed surfaces of liquids or suspensions comprising fastening a plurality means of quadrilateral rain-collection pads detachably secured with said fastening means in a side-by-side arrangement to form a multi-pad continuous cover extending in the X-Y directions on the exposed surfaces of liquids or suspensions, each pad having a horizontal bottom wall, four contiguous side walls, an open top, and a plurality of stiffening braces extending at an angle between the bottom wall and the side walls to maintain at least one side wall at a substantially right angle to the bottom wall, one end of each brace being attached to the inner surface of the bottom wall away from the side wall and the other end of each brace being attached to the top portion of the inner surface of a side wall.

44. A rain collection system for exposed surfaces of liquids or suspensions comprising fastening means, a plurality of quadrilateral rain-collection pads detachably secured with said fastening means in a side-by-side arrangement to form a multi-pad continuous cover extending in the X-Y directions on the exposed surfaces of the liquids or suspensions, each pad having a horizontal bottom wall, four contiguous side walls, and an open top, said fastening means comprising a U-shaped channel element having an open throat between parallel extending skirt adapted to receive juxtaposed side walls of adjoining pads, and a lock pin adapted to be received within coaxial apertures in the skirts and two juxtaposed side walls of adjoining pads, to detachably secure the channel element and side walls, each pad being adapted to capture rain water and to float in the liquids or suspensions with the outer surface of the horizontal bottom of each pad in contact with the liquids or suspensions.

* * * * *